US006848992B2

(12) United States Patent
Adams

(10) Patent No.: US 6,848,992 B2
(45) Date of Patent: Feb. 1, 2005

(54) AMUSEMENT DEVICE AND ITS ASSOCIATED METHOD OF PLAY

(76) Inventor: Raymond Adams, 3762 Lankenau Rd., Philadelphia, PA (US) 19131

( * ) Notice: Subject to any disclaimer, the term of this patent is extended or adjusted under 35 U.S.C. 154(b) by 363 days.

(21) Appl. No.: 09/923,312

(22) Filed: Aug. 7, 2001

(65) Prior Publication Data

US 2003/0032468 A1 Feb. 13, 2003

(51) Int. Cl.[7] ..... A63F 13/00
(52) U.S. Cl. ..... 463/9; 463/37; 273/454
(58) Field of Search ..... 463/1, 7–9, 36–39; 273/454, 455, 460

(56) References Cited

U.S. PATENT DOCUMENTS 4,285,517 A * 8/1981 Morrison ..... 463/9
4,359,220 A * 11/1982 Morrison et al. ..... 463/9
4,363,482 A 12/1982 Goldfarb ..... 273/1 GC
5,409,213 A * 4/1995 Yeh ..... 473/527
5,672,131 A * 9/1997 Osborne et al. ..... 473/527
5,685,776 A * 11/1997 Stambolic et al. ..... 463/46
5,816,580 A * 10/1998 Osborne et al. ..... 273/454
6,086,478 A * 7/2000 Klitsner et al. ..... 463/35
6,210,278 B1 * 4/2001 Klitsner ..... 463/35

* cited by examiner

*Primary Examiner*—John M Hotaling, II
(74) *Attorney, Agent, or Firm*—LaMorte & Associates

(57) ABSTRACT

An amusement device and method embodied in a hand-held assembly. A plurality of contact targets are disposed on the hand-held assembly. A microprocessor within the amusement device generates and displays a sequence in which the contact targets are to be struck. The player then attempts to strike the contact targets in a pattern that matches the sequence. The contact targets are struck by manipulating the hand-held assembly so that the contact targets become the point of contact between the manipulated hand-held object and an external surface. After the sequence is displayed and the contact targets struck, the microprocessor compares the pattern of contact target strikes to the previously displayed sequence. If there is a match, the sequence is complicated and the play cycle repeated. If there is no match, the game ends.

17 Claims, 5 Drawing Sheets

AMUSEMENT DEVICE AND ITS ASSOCIATED METHOD OF PLAY

BACKGROUND OF THE INVENTION

1. Field of the Invention

The present invention relates to amusement devices of the type that contain a plurality of contact target points that must be contacted in a predetermined sequence in order to advance in the game. More particularly, the present invention game relates to sequenced target games that are controlled by a microprocessor.

2. Prior Art Statement

The prior art record is replete with different types of sequenced target games that present targets for limited periods of time and present players the opportunity to contact those targets within those periods of time. An example of such sequenced target game is the Wack-A-Mole game, where plastic moles emerge briefly from burrows in a random pattern. To play the game, a player is supposed to strike the mole while it is out of its burrow. If the mole is struck, points are obtained.

Other variations of such sequenced target games require that players memorize the sequenced pattern of the presented targets. In such memory-based sequenced target games, players are presented with a game structure having a plurality of different contact targets. The different contact targets are then identified in a predetermined sequence by a microprocessor. The different contact targets are most commonly identified by the use of internal lights that light up contact targets one at a time. Players must then remember the sequence presented by the microprocessor and touch the contact targets in the same sequence. Typically, as the game progresses, the sequence presented by the microprocessor becomes longer and longer, until the player can no longer remember the sequence and errs in touching the contact targets. Such games are exemplified by U.S. Pat. No. 4,363,482 to Goldfarb, entitled Sound-Responsive Electronic Game.

In the prior art, most all embodiments of sequenced target games contain a target field. The target field is typically a game structure that retains a plurality of contact targets in a fixed orientation. The contact targets can be mole heads, illuminated push buttons or the like. However, the positions of the contact targets do not change. In this manner a player can familiarize himself/herself with the location of the contact targets and be ready to touch the contact targets with his/her hand, fingers or a hand-held object.

The present invention is an improvement to the field of sequenced target games. The present invention provides a variable target field, whereby a player does not know and cannot familiarize himself/herself with the location of the contact targets as those contact targets are not identified until the game is being played. As such, a player must not only touch the appropriate contact field at the right time, the player must also locate the contact targets and orient the contact targets so that they can be contacted.

SUMMARY OF THE INVENTION

The present invention is an amusement device and its associated method of play. The amusement device includes a hand-held assembly. A plurality of contact targets are disposed on the hand-held assembly. A microprocessor within the amusement device generates and displays a sequence in which the contact targets are to be struck. The player then attempts to strike the contact targets in a pattern that matches the sequence. The contact targets are struck by manipulating the hand-held assembly so that the contact targets become the point of contact between the manipulated hand-held object and an external surface. After the sequence is displayed and the contact targets struck, the microprocessor compares the pattern of contact target strikes to the previously displayed sequence. If there is a match, the sequence is complicated and the play cycle repeated. If there is no match, the game ends.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE INVENTION

Figure 1:
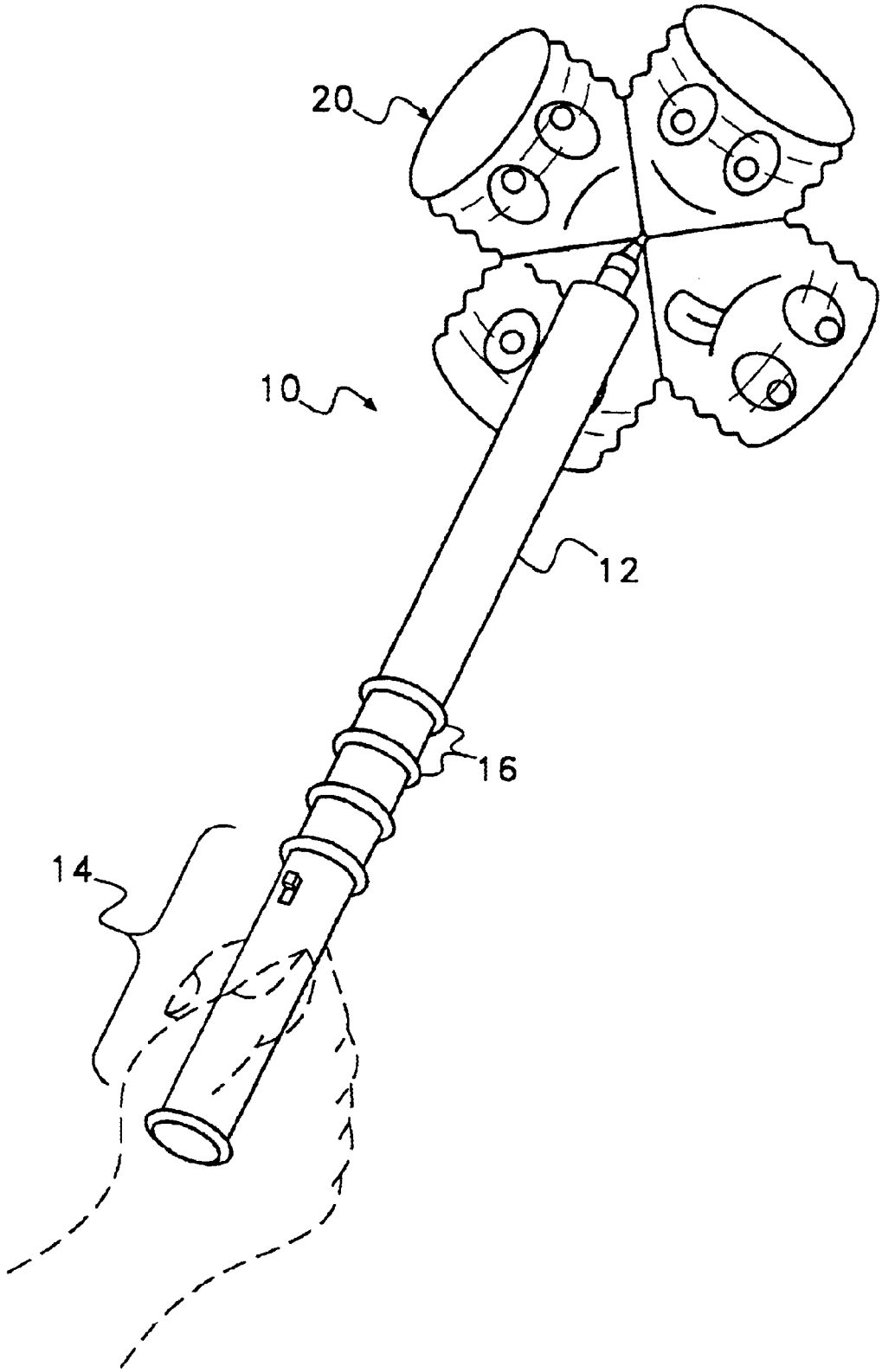
FIG. 1 is a perspective view of a novelty device in accordance with the present invention.

Referring to FIG. 1, an exemplary embodiment of the present invention amusement device 10 is shown. The amusement device 10 contains a shaft 12 having a first end and a second end. The shaft 12 has a length that is preferably between eight inches and three feet. Within the shaft 12 are contained electronics and batteries, as will later be illustrated and described.

A section 14 of the shaft 12, proximate the first end of the shaft 12, is unobstructed so that the shaft 12 can be grasped by a player's hand. In the embodiment of FIG. 1, the section 14 of the handle 12 to be grasped by the player's hand is smooth. However, it should be understood that this section 14 of the shaft 12 can have a padded handle attached around it or can be ergonomically configured into a handle that better conforms to the form of a player's hand.

A series of illuminated rings 16 are located on the shaft 12 between the handle section 14 and the second end of the shaft 12. The illuminated rings 16 are translucent structures that are internally illuminated. The number of illuminated rings 16 corresponds to the number of contact targets 20 used on the amusement device 10. Preferably, the illuminated rings 16 are different colors so as to be readily distinguishable from one another. The colors of the illuminated rings 16 are used to associate the rings 16 with the different contact targets 20, as will later be explained.

A plurality of contact targets 20 are connected to the shaft 12 proximate the second end of the shaft 12. Although four contact targets 20 are shown, it should be understood that any plurality of contact targets can be used. The number of contact targets 20 corresponds to the number of illuminated rings 16 that exist on the shaft 12. Furthermore, each of the contact targets 20 is preferably a different color, wherein the colors of the different contact targets 20 correspond to the color of the different illuminated rings 16. The contact targets 20 need not be the same color as the illuminated rings 16. However, some identifiable relationship has to be present between the illuminated rings 16 and the contact targets 20. For instance, the contact targets 20 can be numbered one through four and the illuminated rings 16 can be numbered one through four. Alternatively, the contact targets 20 can be different shapes and the illuminated rings 16 can be different shapes. Alternatively, yet still, the contact targets 20 can have different names and these names can be written next to the various illuminated rings 16. As such, it will be understood that some mechanism is provided that visually and/or audibly associates each of the illuminated rings 16 to each of the contact targets 20 and visa versa.

Figure 2:
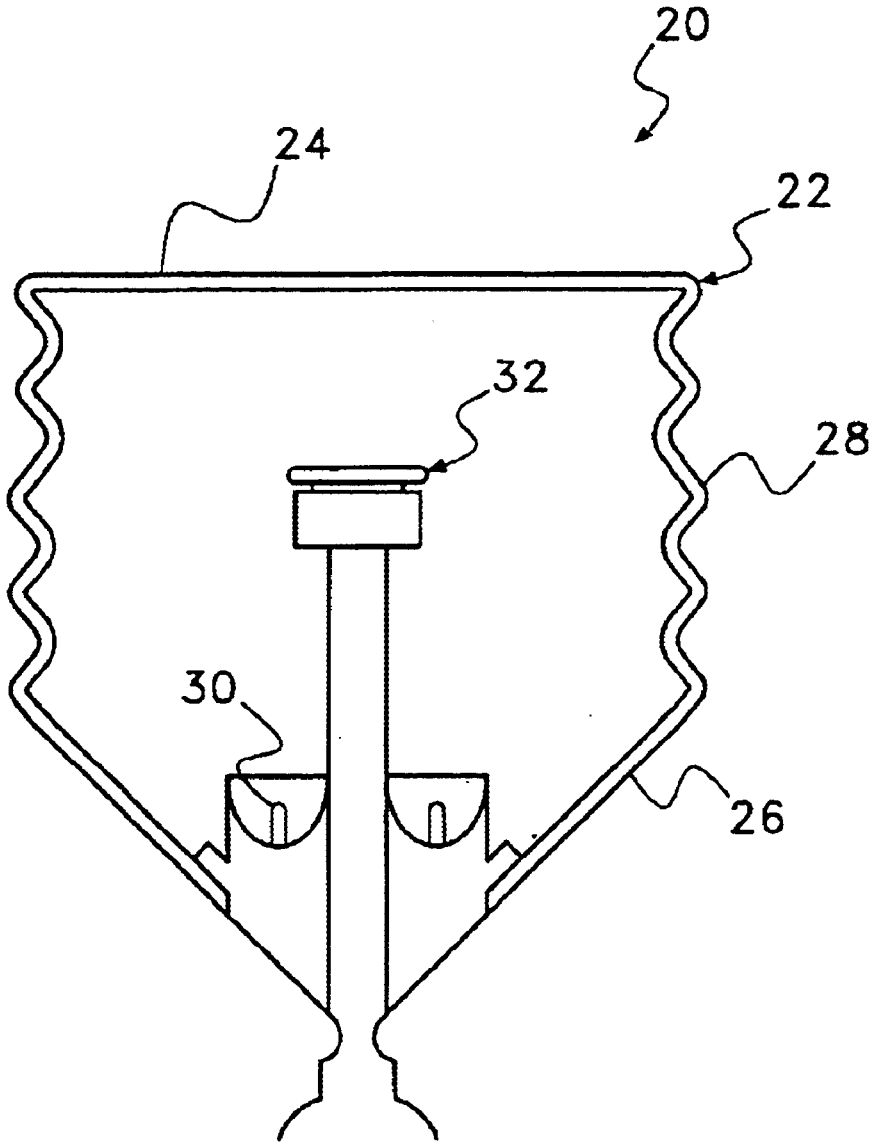
FIG. 2 is a selectively cross-sectioned view of a contact target in accordance with the present invention.

Referring to FIG. 2, it can be seen that each of the contact targets 20 contains an outer structure 22 that is at least partially collapsible. In FIG. 2, the outer structure 22 is a thin molded plastic. The outer structure 22 has a flat top surface 24 and a conical base section 26. The plastic of the sidewall 28 between the conical base section 26 and the top surface 24 is convoluted. As such, when a downward force is applied to the flat top surface 24, the side surface 28 easily collapses. The sidewall 28 is resilient and returns to its fully extended position as soon as the compressing force is removed. If the material selected for the outer structure is not resilient, such as cloth, an internal spring can be provided that returns the outer structure to its fully extended position after being compressed.

An impact sensor 32 is located within the outer structure 22 of the contact target 20. The impact sensor 32 is located a predetermined distance below the top surface 24 of the outer structure 22, when the outer structure 22 is in its fully extended position. In the shown embodiment, the impact sensor 32 is an electrical switch. The state of the switch is changed when the top of the switch is depressed. The switch is located in the contact target 20 at a point so that the switch is contacted when the sidewall 28 of the outer structure 22 collapses and the outer structure 22 is compressed into its fully collapsed position. As such, it will be understood that the state of the switch changes when the outer structure 22 of the contact target 20 collapses on impact. As the switch changes states, a readily detected triggering condition is created by the switch.

The use of a switch is optional. Any electronic impact sensor capable of producing a triggering condition when compressed can be used. Such components include, but are not limited to, electrical switches, piezoelectric material, accelerometers and the like.

In FIG. 2, optional lights 30 are also shown within the contact target 20. The lights 30 are disposed near the base of the contact target 20 and are therefore not affected by the collapse of the contact target 20 when the contact target 20 is struck against an external object. The lights 30 can be used to internally illuminate the contact target 20. This can be used to selectively identify a specific contact target, as will later be explained.

Figure 3:
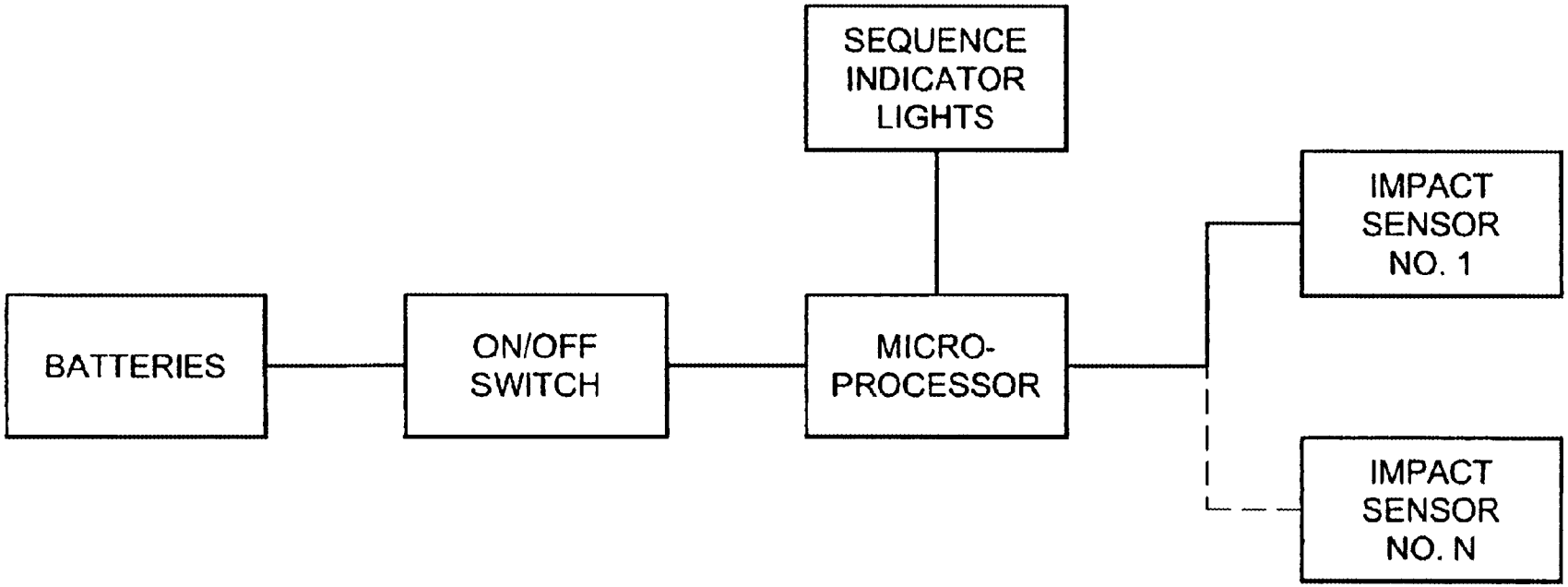
FIG. 3 is a schematic view of the circuitry contained within the present invention.

Referring now to FIG. 3, a schematic of the amusement device 10 is shown. In the shaft 12 (FIG. 1) of the amusement device 10 is located a microprocessor 40 and batteries 42 to power the microprocessor 40. The microprocessor 40 is coupled to impact sensors 32 in the different contact targets 20 (FIG. 2). As such, when any one of the contact targets is struck against an external object, the microprocessor 40 is sent a signal. The signal informs the microprocessor 40 of which contact target was struck and when that contact target was struck. The microprocessor 40 is also coupled to the lights contained in the amusement device 10. The lights may be the illumination source of the illuminated rings 16, shown in FIG. 1 and/or the lights 30 contained within the contact targets, as shown in FIG. 2.

Figure 4:
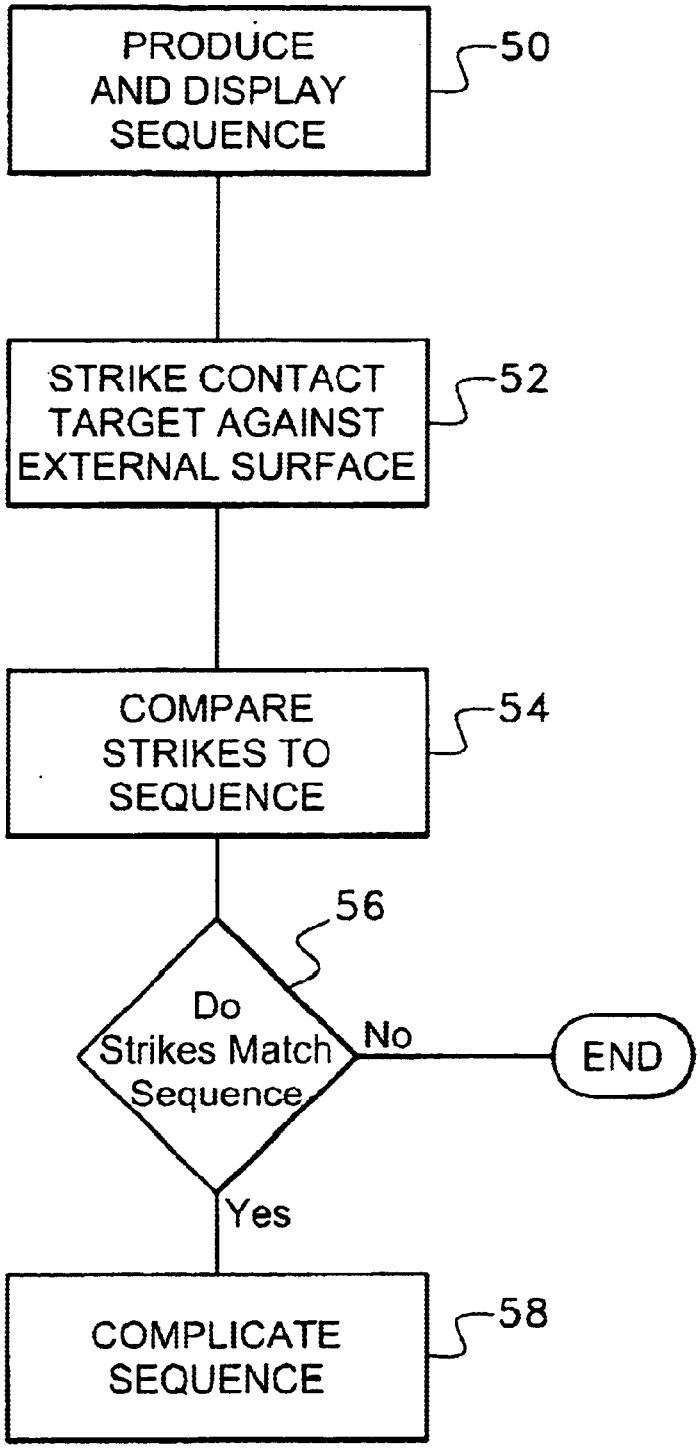
FIG. 4 is a block diagram illustrating the method of play for the present invention.

The microprocessor 40 lights the illumination rings 16 (FIG. 1) and/or the lights 30 (FIG. 2) in the contact targets in a predetermined or random pattern. The illumination rings 16 (FIG. 1) and/or contact target lights 30 (FIG. 2) are lit one at a time. The sequence may begin with the lighting of only one or two lights and can be increased to a sequence of many hundred. Referring now to FIG. 4, it will be understood that the method of play for the amusement device 10 is as follows. First, the microprocessor lights the lights in an initial sequence. The lights can be the lights of the illuminated rings 16 (FIG. 1) or the lights 30 (FIG. 2) within the contact targets. The purpose of lighting the lights is to identify different contact targets. Consequently, if lights 30 (FIG. 2) in different contact targets are lit, the contact targets are uniquely identified. However, if the lights of the illuminated rings 16 (FIG. 1) are lit, the contact heads are indirectly identified. This is so because each of the illuminated rings are associated with a different contact target by color, shape or indicia.

As is indicated by Block 50, once the microprocessor lights a sequence of lights that identifies a sequence of contact targets, a player is supposed to strike the identified contact targets in the same sequence as that identified by the lights. A player strikes the different contact targets by striking the entire amusement device against an external object. By orienting the amusement device, the different contact targets can be brought to bare against the external object. So to strike the different contact targets in a sequence that matches the sequence of lights, the amusement device constantly needs to be reoriented in the player's hand or struck against different objects at different positions relative the player.

As is indicated by Block 52 and Block 54, as the different contact targets are struck in a sequence, signals from the contact targets are received by the microprocessor 40 (FIG. 3) in that same sequence. The microprocessor compares the received sequence of strike signals to the previous sequence of contact target identifiers. As is indicated by Block 56, if the sequence of strike signals from the contact targets matches the previous sequence of contact target identifiers, then the microprocessor complicates the sequence of contact target identifiers and reinstates the sequence. To complicate the sequence of contact target identifiers, the microprocessor can create a new random sequence or add one more contact target identifier to the previous sequence, thereby making the sequence longer and harder to remember. The step of complicating the sequence is shown by Block 58.

If the sequence of the strike signals does not match the sequence of contact target identifiers, then the game ends.

In the embodiment of FIG. 1, the contact targets 20 are rigidly affixed to the shaft 12. As such, when a player wants to strike a specific contact target 20, the position of that contact target 20 is known. The player just strikes that contact target 20 against an external surface. To make the amusement device 10 more challenging to play, a mechanism can be provided in the shaft that rotates the contact targets relative the shaft. In this manner the location of the contact targets is not immediately known by the player. An exemplary embodiment of such an embodiment is shown in FIG. 5.

Figure 5:
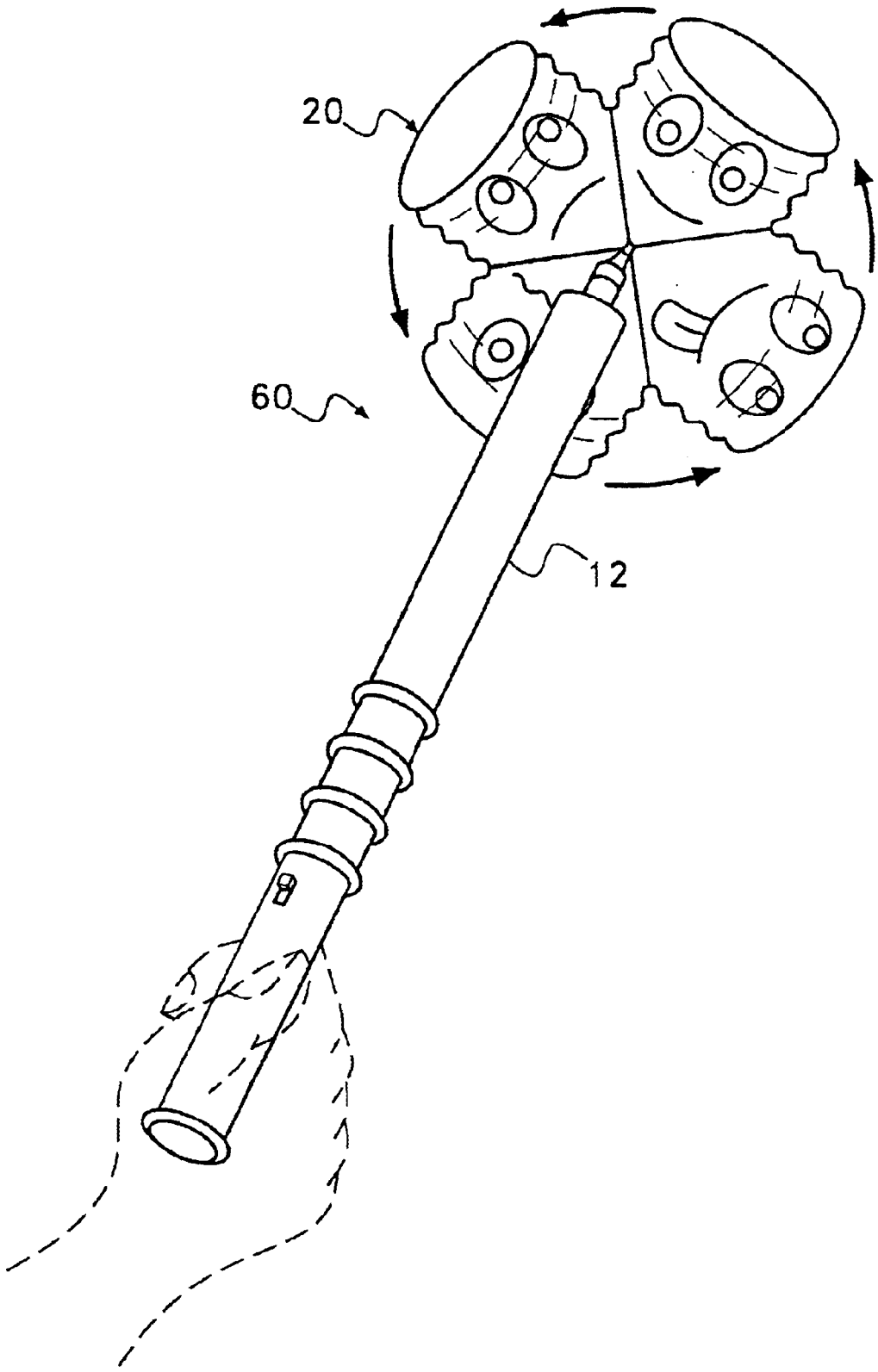
FIG. 5 is a perspective view of an alternate embodiment of the present invention.

Referring to FIG. 5, it can be seen that the contact targets 20 rotate relative the shaft 12 during play. The rotation of the contact targets 20 can be constant or can be random, wherein periods of rotation are dispersed with periods of no motion. The rotation of the contact targets 20 would also be controlled by the microprocessor contained within the shaft 12.

Accordingly, when a player wants to strike a specific contact target 20, that player has to locate that contact target 20 and time the striking of the amusement device 60 against an external surface so that the selected contact target is at the point of contact at the time of contact.

It will be understood that the embodiments of the present invention described and illustrated are merely exemplary and a person skilled in the art can make many variations to the shown embodiments. For example, the number of contact targets can be varied, the appearance of the contact targets can be varied and the manner in which a sequence of contact targets is identified can also be varied. All such alternate embodiments and modifications are intended to be included within the scope of the present invention as defined below in the claims.

What is claimed is:

1. An amusement device, comprising:

a shaft having a first end and a second end;

a plurality of contact targets that radially protrude as salient points from said shaft in at least three different directions, wherein each of said contact targets contains a sensor that senses when that contact target is struck against an external object;

a plurality of indicators, wherein each of said indicators is associated with one of said contact targets; and a microprocessor coupled to said plurality of indicators and to each of said sensors, wherein said microprocessor activates said indicators in a sequence and detects if said contact targets are struck in said sequence.

2. The device according to claim 1, wherein said plurality of indicators are visual indicators that are located on said shaft.

3. The device according to claim 1, wherein said contact targets radially extend from a common point along said shaft.

4. The device according to claim 1, further including a mechanism for moving said contact targets relative said shaft.

5. The device according to claim 3, further including a mechanism for rotating said contact targets around said common point.

6. The device according to claim 1, wherein each of said contact targets is collapsible between an extended position and a compressed position, when said contact targets are struck against an external object with a predetermined force.

7. The device according to claim 6, wherein said contact targets contain a resilient structure that returns each of said contact targets from said compressed position to said extended position after dissipation of said predetermined force.

8. The device according to claim 6, wherein said sensor is a switch disposed in each of said contact targets that is activated when each of said contact targets is compressed in said compressed position.

9. The device according to claim 1, wherein said indicators include colored lights, wherein a color associated with each of said colored lights corresponds to a color of one of said contact targets.

10. The device according to claim 1, wherein said microprocessor alters said sequence each time said sequence is displayed.

11. A game assembly, comprising:

a hand-held object having a shaft having a first end and a second end a plurality of contact targets that radially protrude as salient points from said first end of said shaft in at least three different directions, wherein said contact targets are selectively struck by striking said hand-held object against an external surface;

a sequence indicator for producing a sequence in which said contact targets are to be struck;

a controller for monitoring if said contact targets are struck against an external object in a pattern matching said sequence.

12. The assembly according to claim 11, wherein said hand-held object includes an elongated shaft wherein said plurality of contact targets radially extend from said elongated shaft.

13. The assembly according to claim 12, wherein said sequence indicators include a plurality of lights.

14. A method, comprising the steps of:

providing a hand-held object having a shaft having a first end and a second end a plurality of contact targets that radially protrude from said first end of said shaft said plurality of contact targets extending as salient points in at least three different directions from said hand-held object;

providing an indication on said hand-held object of a sequence in which said plurality of contact targets are to be struck;

striking said contact targets against an external surface in a striking pattern; and determining if said striking pattern matches said sequence.

15. The method according to claim 14, further including the step of rotating said plurality of contact targets relative said hand-held object.

16. The method according to claim 14, wherein said step of providing an indication includes providing a plurality of lights that color match said contact targets and illuminating said plurality of lights in said sequence.

17. The method according to claim 14, wherein said sequence is complicated each time said striking pattern matches said sequence.

* * * * *